United States Patent [19]

Bodine

[11] Patent Number: 4,874,270

[45] Date of Patent: Oct. 17, 1989

[54] METHOD AND APPARATUS FOR REDUCING IMPEDANCE OR CORE MATERIAL IN SONIC PILE DRIVING

[76] Inventor: Albert G. Bodine, 7877 Woodley Ave., Van Nuys, Calif. 91406

[21] Appl. No.: 718,702

[22] Filed: Apr. 1, 1985

[51] Int. Cl.[4] ..... E02D 15/00

[52] U.S. Cl. ..... 405/248; 405/232

[58] Field of Search ..... 405/184, 231, 232, 245–249, 405/175; 175/55, 56; 173/49

[56] References Cited

U.S. PATENT DOCUMENTS

| | | | |
|---|---|---|---|
| 3,076,513 | 2/1963 | Heaphy | 195/55 |
| 3,312,295 | 4/1967 | Bodine | 175/56 X |
| 3,375,884 | 4/1968 | Bodine | 175/55 X |
| 3,766,741 | 10/1973 | Hartzell | 405/232 |

FOREIGN PATENT DOCUMENTS

| | | | |
|---|---|---|---|
| 85023 | 7/1981 | Japan | 173/49 |
| 1429312 | 3/1976 | United Kingdom | 405/248 |

*Primary Examiner*—Dennis L. Taylor
*Assistant Examiner*—J. Russell McBee
*Attorney, Agent, or Firm*—Edward A. Sokolski

[57] ABSTRACT

A compliant foam is introduced into the bottom of a pile casing being resonantly sonically driven into the ground. The foam mixes with earthen material which has entered the interior of the casing and is presenting impedance to the sonic driving of the pile. This foam material effectively makes the earthen material more compliant and thus effectively lowers the impedance presented by such material, thereby increasing the acoustical "Q" of the resonantly vibrating pile member.

5 Claims, 1 Drawing Sheet

Figure 1:
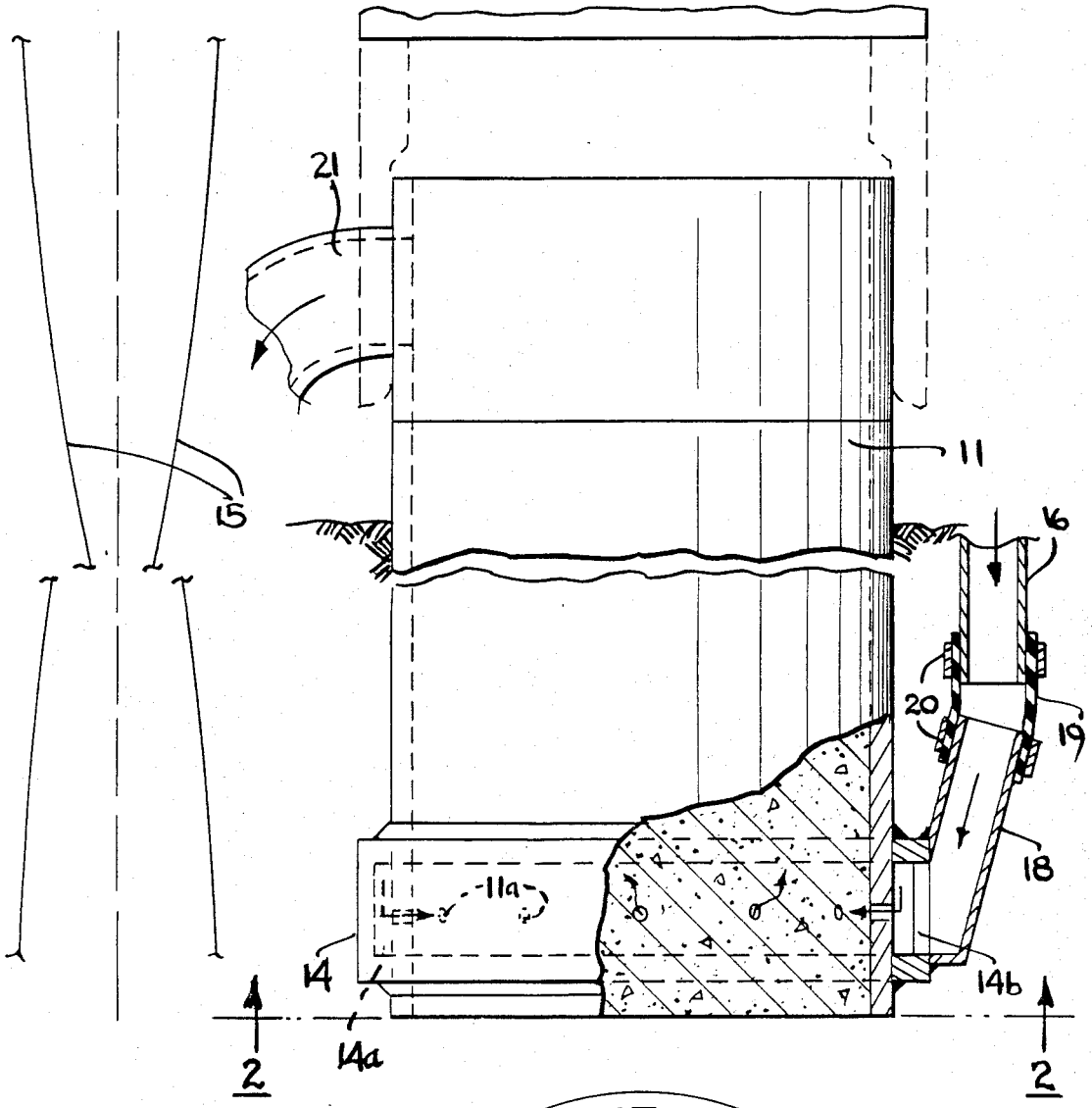

METHOD AND APPARATUS FOR REDUCING IMPEDANCE OR CORE MATERIAL IN SONIC PILE DRIVING

This invention relates to the sonic driving of piles and more particularly, to a method and apparatus for improving the vibration in a resonantly driven pile member.

In the sonic driving of piles, as described for example, in my U.S. Pat. No. 3,291,227, the use of sonic energy is described for efficiently driving piles into earthen formations. In the systems described in the aforementioned patent, an orbiting mass oscillator is employed to resonantly vibrate the casing. It has been found that in certain pile driving situations where open ended casings or pipes are employed, a tightly compact core of earthen material becomes lodged in the interior of the casing, particularly at the extreme lower end thereof. This mass of core material, places a friction (resistive) coupled, mass impedance load on the resonantly vibrating system which impedes the vibration cycle of the pile. The load of this core material, thus, acts as a friction damper on the vibrating system substantially lowering the effective "Q" of the resonant vibration system. Further, the core material becomes increasingly dense in response to the vibratory energy in view of the fluidization of the earthen material which occurs. This dense, heavy core of earthen material presents an inertial load on the pile which not only is frictional in nature, but also presents mass reactance to the vibrating system resulting in a drag or "phase lag" effect akin to the effect of an inductance in an electrical circuit as is pointed out below. This problem, could, of course, be avoided by preventing the core from entering the casing in the first place by pumping water in from the top of the casing. Such a liquid build up around a pile could produce undesirable effects such as the interconnection of undesirable earthen fluid layers with water wells.

The system of the present invention counteracts these deleterious effects by introducing a liquid foam or gaseous material at the bottom end of the casing so that gas bubbles are mixed with any earthen core material that may be present. This adds acoustic compliance to the mass of the core material and effectively counteracts the acoustic damping effect of such material on the resonant vibration system. In a preferred embodiment of the invention this introduced fluid typically may be in the form of compressed air mixed into soapy water. This foam material is introduced into the interior of the bottom of the pile in any convenient manner, typically through apertures formed in the pile casing from an annular manifold or shoe which is attached to the bottom of the casing by suitable means such as welding. The foam material is fed to the manifold or shoe by means of a hose or pipe member which runs to the surface.

The foam material thus introduced not only reduces the frictional effects but also effectively reduces the mass reactance of the core by introducing shunt compliance so that the core tends to induce less of a "phase lag" into the vibration of the pile. Also, the speed of the sonic energy in the core material is reduced by virtue of the foam which effectively tends to vibrationally isolate the core material from the vibrational system, thus minimizing the dissipation of energy therein.

It has been found most helpful in analyzing the operation of this invention to analogize the acoustically vibrating circuit utilized to an equivalent electrical circuit. This sort of approach to analysis is well known to those skilled in the art and is described, for example, in Chapter 2 of "Sonics" by Heueter and Bolt, published in 1955 by John Wiley and Sons. In making such an analogy, force F is equated with electrical voltage E, velocity of vibration $\omega$ is equated with electrical current I, mechanical compliance $C_m$ is equated with electrical capacitance $C_e$, mass M is equated with electrical inductance L, mechanical resistance (friction) $R_m$ is equated with electrical resistance R and mechanical impedance $Z_m$ is equated with electrical impedance $Z_e$.

Thus it can be shown that if a system is vibrated by means of an acoustical sinusoidal force $F_0 \sin \omega t$ ($\omega$ being equal to $2\pi$ times the frequency of vibration), that:

$$Z_m = R_m + K\omega M - 1/\omega C_m) = F_o \sin \omega t/u \quad (1)$$

Where $\omega M$ is equal to $1/\omega C_m$ a resonant condition exists, and the effective mechanical impedance $Z_m$ is equal to the mechanical resistance $R_m$, the reactive impedance components $\omega M$ and $1/\omega C_m$ cancelling each other out. Under such a resonant condition, velocity of vibration $\mu$ is at a maximum, power factor is unity, and energy is more efficiently delivered to a load to which the resonant system may be coupled. It can also be shown that the resonant vibration frequency, "F" of the system, ($\omega$ being equal to $2\pi f$ is as follows:

$$F = 1/2\pi \sqrt{MC_m} \quad (2)$$

It is important to note the significance of the attainment of high acoustical "Q" in the resonant system being driven, to increase the efficiency of the vibration thereof and to provide a maximum amount of power. As for an equivalent electrical circuit "Q" is defined as the sharpness of resonance thereof and is indicative of the ratio of the energy stored in each vibration cycle to the energy used in each such cycle. "Q" is mathematically equated to the ratio between $\omega M$ and $R_m$. Thus, the effective "Q" of the vibrating circuit can be maximized to make for highly efficient high amplitude vibration by minimizing the effect of friction in the circuit. The present invention is directed to maximizing "Q" by lowering the acoustic damping presented by the core which results from the combined effects of the large mass impedance of the core slug being frictionally engaged with the inside wall of the casing.

It is thus an object of the present invention to lower the effective resistance $R_m$ placed on the bottom of a pile member which tends to reduce the "Q" of the resonant vibration of the system.

It is another object of this invention to reduce the normal earthen mass impedance effect of the core slug by interspersing gas bubbles, such as by foam or the like, throughout the core granules so as to thus introduce shunt compliance to counterbalance the mass impedance.

It is a further object of this invention to improve the sonic driving of pile members into earthen material.

It is still a further object of this invention to lower the impedance or cyclic drag placed on a sonically driven pile member by cored earthen material to thereby improve the driving action.

Figure 2:
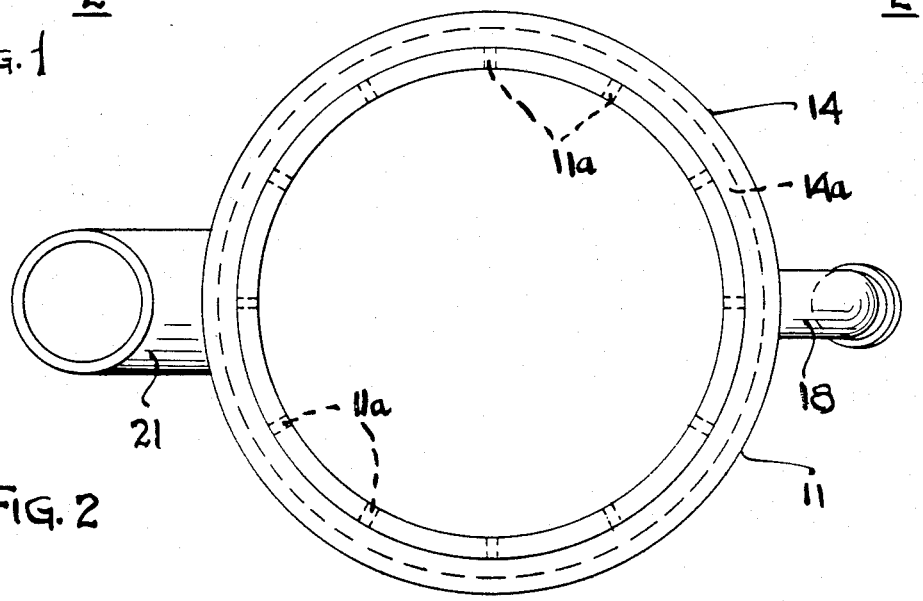

Other objects of the invention will become apparent as the description proceeds in connection with the accompanying drawings of which:

FIG. 1 is an elevational view and cross section of a preferred embodiment of the invention; and FIG. 2 is a cross sectional view taken along the plane indicated by 2—2 in FIG. 1.

Referring now to the figures, pile member 11 which is in the form of a tubular casing, is typically about 10 inches in diameter and 40–60 feet in length, and is sonically driven as described in my aforementioned patent or patent application to produce sonic resonant vibration of the casing to effect a standing wave vibration pattern in the casing as indicated by the velocity wave form diagram 15. One convenient system for gas bubble introduction may be shoe member 14 which is cylindrical in form and is welded onto the bottom of casing 11. Shoe member 14 forms a concentric channel 14*a* around the bottom of the casing. Foam or gaseous material is fed to this channel through a conduit member 16, which runs to the surface along the outside of the casing. Hose member 19 which may be of flexible material is clamped between rigid pipe member 18 and conduit 16, by means of hose clamps 20. Pipe member 18 is welded to shoe 14 around aperture 14*b* in the shoe to provide an entry for the foam material into concentric channel 14*a*. The foam material is fed from channel 14*a* through apertures 11*a* formed around the bottom end of casing 11. An outflow gooseneck fitting 21 is welded to the casing or casing clamp near the top end thereof to provide an outflow from the casing for the foam and core material. The foam may be formed by compressed air and also may include water and soap.

While the invention has been described and illustrated in detail, it is to be clearly understood that this is intended by way of illustration and example only, and is not to be taken by way of limitation. The spirit and scope of the invention being limited only by the terms of the following claims:

I claim:

1. In a pile driving apparatus, for sonically driving a tubular pile member having an open bottom end into an earthen formation, the improvement being means for lowering the impedance presented to the sonic driving action by earthen core material lodged in the open bottom end comprising:

a cylindrical shoe member attached to the bottom of the pile member in concentricity therewith, said shoe member forming a concentric channel around the pile member;

said pile member having apertures formed around the bottom end thereof, said apertures providing fluid communication between said concentric channel and the earthen core material, and means for feeding foam material to the said shoe member, said foam material being mixed with the core material so as to lower the impedance thereof to the sonic driving.

2. The apparatus of claim 1 wherein the shoe member is fixedly attached to the pile member.

3. The apparatus of claim 1 wherein the means for feeding foam material to the shoe member comprises a pipe member fixedly attached to the shoe member and a hose attached to the pipe member.

4. The apparatus of claim 1 wherein the foam material comprises compressed air mixed with a liquid.

5. A method for lessening the acoustic impedance presented to a pile member by earthen core material lodged in the bottom open end thereof comprising:

forming a concentric channel around the bottom of the pile member, forming apertures in the wall of the pile member opposite said concentric channel, sonically vibrating the pile member to cause it to penetrate into the earth, and while the pile member is being sonically driven, feeding an acoustically compliant fluid to said concentric channel for dispersement through said apertures into the core material so as to mix therewith.

* * * * *